US006553786B1

(12) United States Patent
Kwiat

(10) Patent No.: US 6,553,786 B1
(45) Date of Patent: Apr. 29, 2003

(54) JEWELRY DESIGN EMPLOYING FLUORESCENT DIAMONDS TO CREATE A HIDDEN MESSAGE

(75) Inventor: Sheldon F. Kwiat, Great Neck, NY (US)

(73) Assignee: Kiwiat, Inc., New York, NY (US)

( * ) Notice: Subject to any disclaimer, the term of this patent is extended or adjusted under 35 U.S.C. 154(b) by 0 days.

(21) Appl. No.: 09/420,898

(22) Filed: Oct. 18, 1999

(51) Int. Cl.[7] ..... A44C 17/02
(52) U.S. Cl. ..... 63/26; 63/28; 63/32
(58) Field of Search ..... 63/26, 27, 28, 63/32

(56) References Cited

U.S. PATENT DOCUMENTS

| | | | | |
|---|---|---|---|---|
| 1,301,568 A | | 4/1919 | Johnson | |
| 1,511,140 A | | 10/1924 | Sauvage | |
| 1,529,831 A | * | 3/1925 | Brennan | 40/583 |
| 2,199,222 A | | 4/1940 | Glaenzer | |
| 2,259,909 A | | 10/1941 | Reed | |
| 2,568,212 A | | 9/1951 | Backman | |
| 2,587,972 A | | 3/1952 | Crise | |
| 4,042,673 A | | 8/1977 | Strong | |
| 4,220,016 A | | 9/1980 | Frenges | |
| 4,301,134 A | | 11/1981 | Strong | |
| 4,841,155 A | | 6/1989 | Ushida | |
| 5,040,480 A | | 8/1991 | Iwazaki et al. | |
| 5,141,460 A | | 8/1992 | Jaskie et al. | |
| 5,401,561 A | | 3/1995 | Fisun et al. | |
| 5,519,591 A | | 5/1996 | MCrary | |
| 5,664,440 A | | 9/1997 | Roemes | |
| 5,703,435 A | | 12/1997 | Kumar et al. | |
| 5,853,826 A | | 12/1998 | Starcke et al. | |
| 5,883,389 A | | 3/1999 | Spear et al. | |

OTHER PUBLICATIONS

Moses, et al. "A Contribution to Understanding the Effect of Blue Fluorescence on the Appearance of Diamonds", Gems & Gemology Winter 1997, vol. XXXIII pp. 243–259, Giemological Institute of America, 1997.

* cited by examiner

*Primary Examiner*—J. J. Swann
*Assistant Examiner*—Andrea Chop
(74) *Attorney, Agent, or Firm*—Lawrence C. Chasin

(57) ABSTRACT

A jewelry design including a mounting made of a precious jewelry metal, a plurality of fluorescent diamonds having at least medium blue fluorescent intensity which are set in the mounting to form a message, and a plurality of non fluorescent diamonds set within the mounting adjacent the fluorescent diamonds, such that when the mounting is viewed under standard light the fluorescent diamonds are not discernable from the non fluorescent diamonds and the message is not visible, and such that when the mounting is viewed under ultraviolet light the fluorescent diamonds emit visible blue light to form and reveal the message.

2 Claims, 2 Drawing Sheets

JEWELRY DESIGN EMPLOYING FLUORESCENT DIAMONDS TO CREATE A HIDDEN MESSAGE

BACKGROUND OF THE INVENTION

The present invention relates to jewelry designs and hidden messages, and, more particularly, to the use of fluorescent diamonds in a jewelry design to create a hidden message.

Hidden messages, as opposed to secret messages, are messages which are not discernable when they are observed in an obstructed or concealed mode, but which are easily discernable when the obstruction is removed. Secret messages, on the other hand, refer to messages which require a secret code or the like to unscramble and thus decipher.

Jewelry has been used for ages to adorn men and women. It provides a means of expression and of complimenting one's clothing. As such, neither hidden nor secret messages are typically employed in jewelry designs. However, a locket or pocket watch might open to reveal a picture of a loved one or a special messages inscribed inside.

Today, diamonds are one of the most popular gemstones used in jewelry design. One of the physical properties of diamond is fluorescence, which is the emission of visible light when the diamond is stimulated by ultraviolet (UV) or other form of radiation. Blue is the most common fluorescent color and appears in approximately 34% of all diamonds when exposed to UV radiation. Of the 34% of diamonds which fluoresce blue, 62% of these diamonds (or 21% of all diamonds) fluoresce with a medium to very strong intensity so as to be easily discernable.

Many people, both inside and outside the jewelry industry, have a negative image of fluorescent diamonds in general. Furthermore, it is a widespread belief that medium to very strong blue fluorescence has a negative effect on better colored diamonds. As a result of these beliefs, fluorescent diamonds typically sell for up to 15% less than comparable non fluorescent diamonds of the same color and clarity.

In order to dispel the uncertainty and mistaken beliefs surrounding fluorescence, the Gemological Institute of America (GIA) conducted an investigation of diamond fluorescence. The results of this investigation were published in an article entitled "A Contribution to Understanding the Effect of Blue Fluorescence on the Appearance of Diamonds", by Thomas Moses, et al., *Gems & Gemology,* Volume 33, No. 4, Winter 1997, which is incorporated by reference herein as it sets forth a thorough analysis of the industry beliefs concerning fluorescence as well as the state of the art concerning the use and effect of fluorescent diamonds. Of particular interest, it is to be noted that the GIA uses the intensity of the fluorescence as a means of identifying a diamond, in addition to the diamonds weight, color, clarity and proportions.

SUMMARY OF THE INVENTION

The present invention utilizes the generally perceived "undesirable" fluorescent diamonds to form a hidden message in a jewelry design. Accordingly, a jewelry design constructed according to the teaching of the present invention includes a mounting made of a precious jewelry metal, a plurality of fluorescent diamonds having at least medium blue fluorescent intensity which are set in the mounting to form a message, and a plurality of non fluorescent diamonds set within the mounting adjacent the fluorescent diamonds. When the mounting is viewed under standard light the fluorescent diamonds are not discernable from the non fluorescent diamonds and the message is not visible. When the mounting is viewed under ultraviolet light the fluorescent diamonds emit visible blue light to form and reveal the message.

DETAILED DESCRIPTION OF THE PREFERRED EMBODIMENTS

Figure 1:
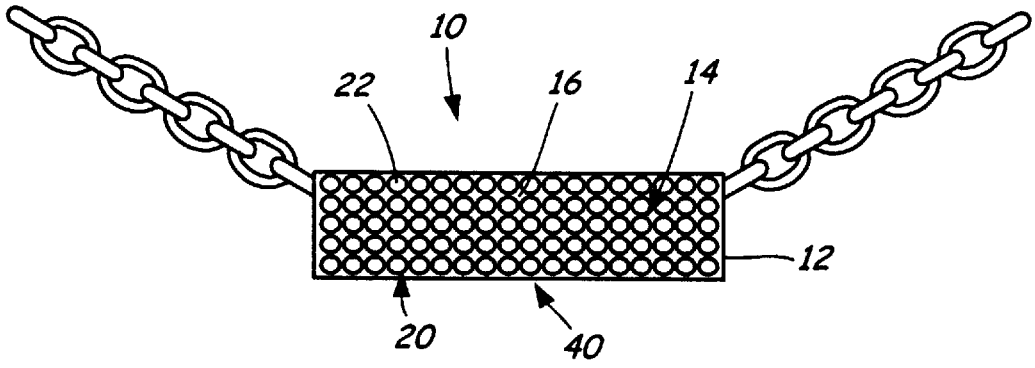
FIG. 1 is an elevational view of a jewelry design under normal light according to the teachings of the present invention.

FIG. 1 illustrates a jewelry design accoriding to the teaching of the present invention in the form of a pendant 10 which is worn around a persons neck. Other jewelry designs might include pins, rings, bracelets or earrings.

The pendant 10 incldues a mounting 12 made of a precious jewelry metal, such as gold or platinum, and diamonds 14 set into the metal mounting by pave beads 16 or one of several other well known techniques including prongs, bars, bezel, bead or channel. Other precious or semi-precious gemstones may be set in addition to the diamonds 14.

The diamonds 14 include a first group of fuorescent diamonds 20 having at least medium blue fluorescent intensity, and a second group of non fluorescent diamonds 22. The diamonds 14 may have any color, clarity and weight, although it is most desirable to use diamonds having D-J color, I-1 or better clarity, and a weight between 0.01 and 0.50 cts.

Figure 2:
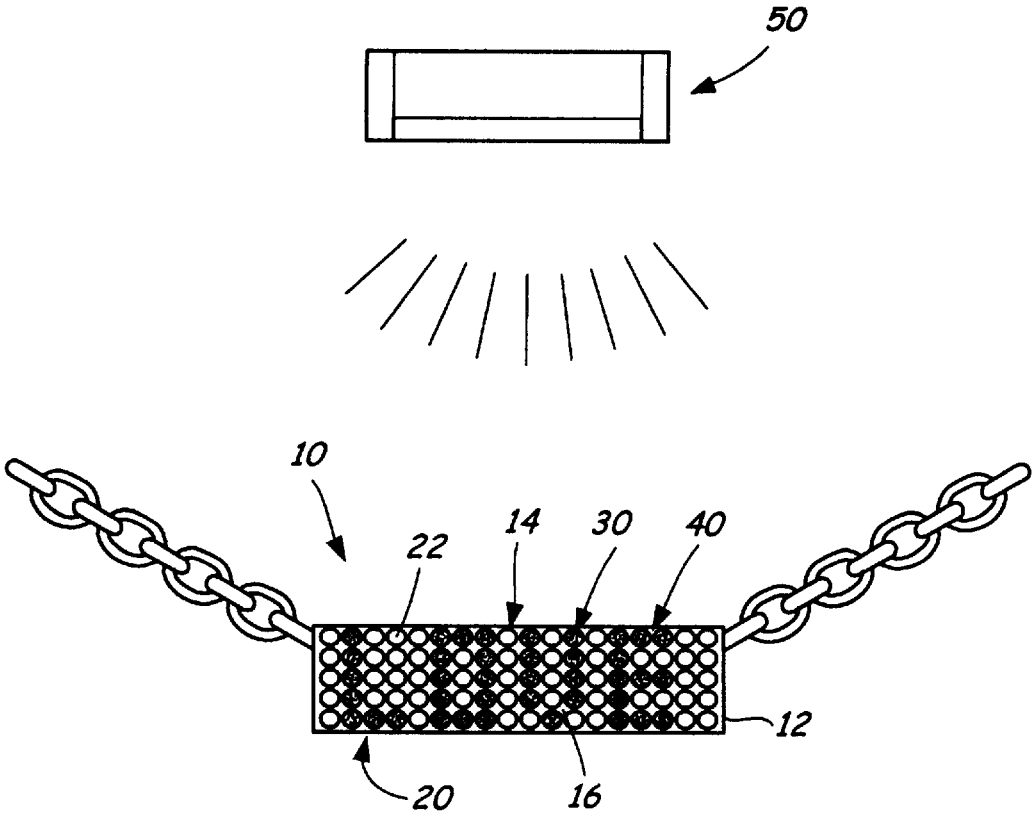
FIG. 2 is an elevational view of the jewelry design of FIG. 1, under ultraviolet light.
Figure 3:
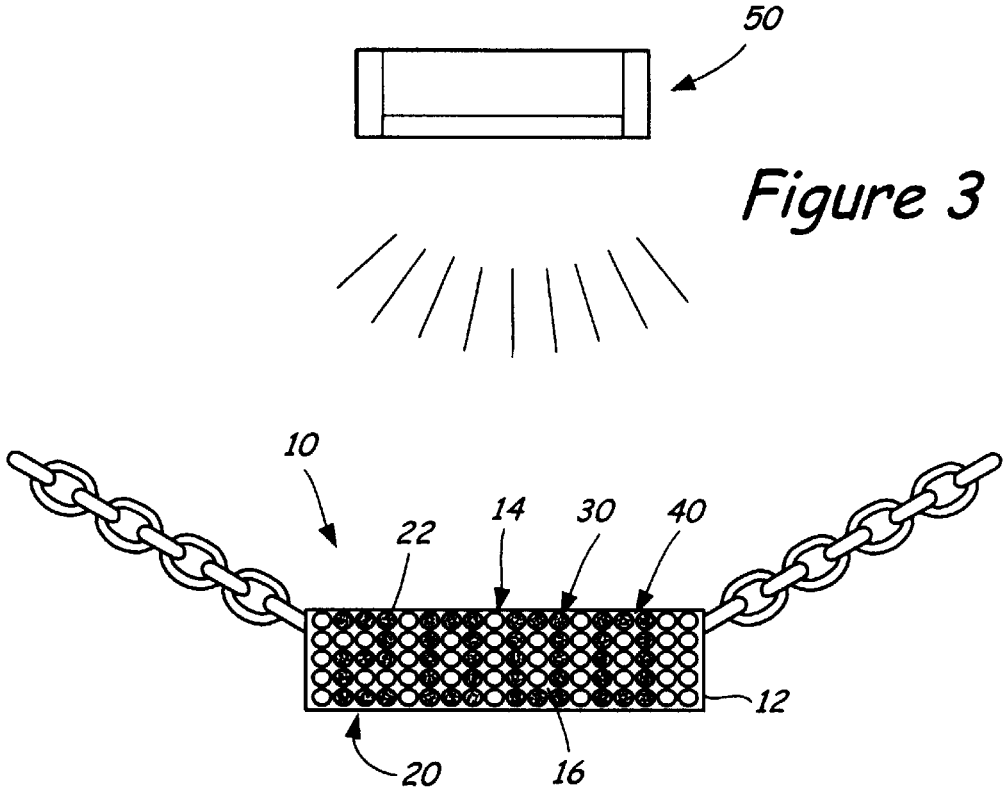
FIG. 3 is an elevational view of another jewelry design under ultraviolet light according to the teachings of the present invention.

The fluorescent diaomnds 20 are set in the mounting to form a message 30 which can be alphanumeric text (see FIGS. 2 and 3), such as the word "LOVE" or the number "2000," or geometric symbols (see FIG. 4), such as a heart-shape. In the case of alphanumeric text, the fluorescent diamonds 20 are set among and between the non fluorescent diamonds 22 to form a diamond region 40 on the piece of pendant 10. The diamond region 40 functions to obscure or hide the fluorescent diamonds 20 under normal daylight. In other words, when the mounting 12 is viewed under standard or daylight light the fluorescent diamonds 20 are not discernable from the non fluorescent diamonds 22 and the message 30 is not visible. As shown in FIG. 2, when the mounting 12 is viewed under an ultraviolet light source 50 the fluorescent diamonds 20 emit visible blue light to form and reveal the message 30. It is preferred that each diamond of the group of fluorescent diamonds 20 separately exhibits at least strong blue fluorescence to provide maximum emission of visible blue light and thereby aid in the detection of the message 30.

More particularly with regard to the construction of the pendant, the mounting 12 is made of any precious jewelry metal such as gold, sliver or platinum and is cast, stamped or hand-made according to well-known techniques. The fluorescent diamonds 20 are sorted under an ultraviolet light source 50 from a large parcel which includes both fluorescent and non fluorescent diamonds. The fluorescent and non fluorescent diamonds are separately sorted for the appropriate size, color and clarity. The mounting 12 is prescribed with an imaginary grid of rows and columns. Parcel papers are prepared, numbered with the appropriate row and column grid numbers, and then filled with either the fluorescent or non fluorescent diamonds. The setter, who does not generally work under ultraviolet light, must carefully interpret the row and column description on the parcel papers in order to accurately set the fluorescent diamonds 20 to form the message 30. This technique works best for pave or bead settings.

Another way to set the fluorescent diamonds 20 is to use a water soluble, visible ink to mark the openings on the mounting 12 where the fluorescent diamonds 20 are to be set. After the diamonds 14 are set, the ink can then be steamed-off so as not to leave a residue. This technique works best for prong, channel or bezel settings.

Figure 4:
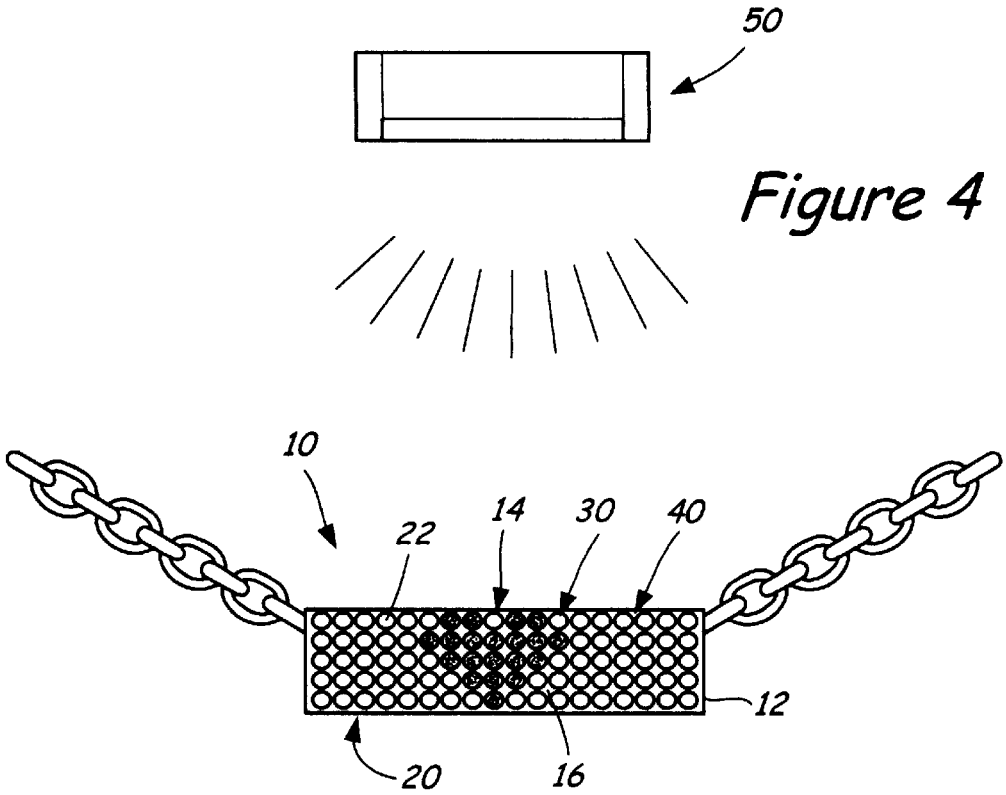
FIG. 4 is an elevational view of another jewelry design under ultraviolet light according to the teachings of the present invention.

FIG. 4 illustrates the case of the fluorescent diamonds 20 being set to show a geometric message 30, such as a heart shape, which implies "I love you" or "You're in my heart". The heart-shaped message 30 is visible in the diamond region 40 only when the mounting 12 is viewed under an ultraviolet light source 50.

The hand-held portable ultraviolet light source 50 may be used and sold in connection with the jewelry design of the present invention, such as "The Illuminator Fluorescent Flashlight Fun" which is manufactured by Think Of It! based in San Francisco, Calif. The hand-held UV light source enables one to reveal and see the hidden message at any time.

Although the present invention has been described with reference to preferred embodiments, workers skilled in the art will recognize that changes may be made in form and detail without departing from the spirit and scope of the invention.

What is claimed is:

1. A jewelry design comprising:

a mounting made of a precious jewelry metal;

a plurality of fluorescent diamonds having at least medium blue fluorescent intensity, which are set in the mounting to form an alphanumeric text message; and a plurality of non fluorescent diamonds set in die mounting adjacent the alphanumeric text message to form a diamond region and to hide the alphanumeric text message when the mounting is viewed under standard light wherein the fluorescent diamonds are not discernable from the non fluorescent diamonds within the diamond region so that the message is not visible, and wherein the alphanumeric text message is visible only when the mounting is viewed under ultraviolet light wherein the fluorescent diamonds are emitting visible blue light to form and reveal the alphanumeric text message within the diamond region.

2. A kit for viewing a hidden alphanumeric text message in a jewelry item comprising:

a jewelry item including a mounting made of a precious jewelry metal; a plurality of fluorescent diamonds having at least strong blue fluorescent intensity and which are set in the mounting to form the hidden alphanumeric text message; and a plurality of non fluorescent diamonds set within mounting adjacent the fluorescent diamonds, such that when the mounting is viewed under standard light the fluorescent diamonds are not discernable from the non fluorescent diamonds and the hidden alphanumeric text message is not visible, and such that only when the mounting is viewed under ultraviolet light do the fluorescent diamonds emit visible blue light to form and reveal the hidden alphanumeric text message; and a hand-held portable ultraviolet light source for viewing the mounting under ultraviolet, light to detect the hidden alphanumeric text message.

* * * * *